US011051550B2

(12) United States Patent
Lin et al.

(10) Patent No.: US 11,051,550 B2
(45) Date of Patent: Jul. 6, 2021

(54) ELECTRONIC CIGARETTE VAPORIZER WITH LIQUID STORAGE TRANSITION CHAMBER

(71) Applicant: Guangrong Lin, Guangdong (CN)

(72) Inventors: Guangrong Lin, Guangdong (CN); Xianbin Zheng, Guangdong (CN)

(73) Assignee: Guangrong Lin, Shenzhen (CN)

( * ) Notice: Subject to any disclaimer, the term of this patent is extended or adjusted under 35 U.S.C. 154(b) by 241 days.

(21) Appl. No.: 16/334,608

(22) PCT Filed: Sep. 8, 2017

(86) PCT No.: PCT/CN2017/101100
§ 371 (c)(1),
(2) Date: Mar. 19, 2019

(87) PCT Pub. No.: WO2018/050030
PCT Pub. Date: Mar. 22, 2018

(65) Prior Publication Data

US 2020/0367556 A1 Nov. 26, 2020

(30) Foreign Application Priority Data

Sep. 19, 2016 (CN) ..... 201610832138.7

(51) Int. Cl.
*A24F 13/00* (2006.01)
*A24F 17/00* (2006.01)
(Continued)

(52) U.S. Cl.
CPC ..... *A24F 40/42* (2020.01); *A24F 40/46* (2020.01); *A24F 40/48* (2020.01); *A24F 40/485* (2020.01); *A24F 15/015* (2020.01); *A24F 40/10* (2020.01)

(58) Field of Classification Search
CPC ..... A24F 47/008; A24F 47/002; A24F 40/40; A24F 40/46
(Continued)

(56) References Cited

U.S. PATENT DOCUMENTS

2013/0319438 A1* 12/2013 Liu ..... A24F 47/008 131/329
2015/0342258 A1* 12/2015 Chen ..... A24F 40/42 131/329
(Continued)

FOREIGN PATENT DOCUMENTS

CN 203168035 U 9/2013
CN 203633502 U 6/2014

OTHER PUBLICATIONS

International Search Report of PCT Patent Application No. PCT/CN2017/101100 dated Dec. 13, 2017.

*Primary Examiner* — Hae Moon Hyeon

(57) ABSTRACT

An electronic cigarette vaporizer with a liquid storage transition chamber comprises a liquid reservoir comprising an upper wall at its top end and a vapor outlet tube extends downwards from the center of the upper wall, and a vaporizing device comprising a vaporizing base sleeved in the lower part of the liquid reservoir, and a liquid storage chamber is defined above the vaporizing device between the liquid reservoir and the vapor outlet tube; and inner and outer chambers sealed from each other are formed inside the vaporizing base, the inner chamber mounted with a vaporizing unit serves as a vaporizing chamber, and the outer chamber filled with liquid storage medium serves as a liquid storage transition chamber, wherein the vaporizing chamber communicates with the vapor outlet tube, and the liquid storage transition chamber communicates with the liquid storage chamber so as to supply liquid for the vaporizing unit.

10 Claims, 9 Drawing Sheets

(51) Int. Cl.

| | |
|---|---|
| ***A24F 25/00*** | (2006.01) |
| ***A24F 40/42*** | (2020.01) |
| ***A24F 40/48*** | (2020.01) |
| ***A24F 40/46*** | (2020.01) |
| ***A24F 40/485*** | (2020.01) |
| *A24F 40/10* | (2020.01) |
| *A24F 15/015* | (2020.01) |

(58) Field of Classification Search
USPC ..... 131/328, 329
See application file for complete search history.

(56) References Cited

U.S. PATENT DOCUMENTS

| | | | | |
|---|---|---|---|---|
| 2016/0249683 | A1* | 9/2016 | Li | A24F 40/485 131/329 |
| 2016/0366941 | A1* | 12/2016 | Lin | B29C 70/766 |
| 2017/0150754 | A1* | 6/2017 | Lin | A24F 40/40 |
| 2019/0174832 | A1* | 6/2019 | Lin | A24F 47/008 |
| 2019/0223504 | A1* | 7/2019 | Chen | A24F 40/485 |
| 2019/0364972 | A1* | 12/2019 | Lin | A24F 40/40 |
| 2019/0387800 | A1* | 12/2019 | Lin | H05B 3/44 |

* cited by examiner

ELECTRONIC CIGARETTE VAPORIZER WITH LIQUID STORAGE TRANSITION CHAMBER

FIELD OF THE INVENTION

The present invention relates to the technical field of electronic cigarettes, and in particular, the present invention relates to an electronic cigarette vaporizer with a liquid storage transition chamber.

BACKGROUND OF THE INVENTION

Conventional tobacco cigarettes contain tobacco tars which may be introduced into the human body by inhalation during smoking and thus are very harmful to the human body. The electronic cigarettes usually heat the e-cigarette liquid by means of a vaporizing device, to produce vapor for the smoker. Since the e-cigarette liquid does not contain the tobacco tar, the e-cigarettes are widely used and gradually replace the tobacco cigarettes.

Existing electronic cigarettes and electronic cigarette vaporizers usually are arranged with a liquid storage chamber for storing the e-cigarette liquid, and the vaporizing device may be arranged with a the vaporizing unit, by means of which the e-cigarette liquid directly absorbed from the liquid storage chamber can be heated and vaporized. However, since the junction part between the vaporizing unit and the liquid storage chamber can hardly be sealed completely, the e-cigarette liquid can be free to flow inside the liquid storage chamber in normal conditions and may leak into the vaporizing chamber through the vaporizing unit under gravity. In such case, droplets of the e-cigarette liquid may enter the user's mouth during smoking and lead to undesired taste or even a failure. Moreover, in order to avoid liquid leakage, some existing electronic cigarettes or electronic cigarette vaporizers are additionally arranged with a layer of permeable membrane for obstructing a flow of the e-cigarette liquid between the liquid storage chamber and the vaporizing unit, which membrane however may lead to a short supply of the e-cigarette liquid and result in a lack of sufficient vapor during smoking.

SUMMARY OF THE INVENTION

Technical Problems

The present invention aims to provide an electronic cigarette vaporizer with a liquid storage transition chamber which can avoid liquid leakage and meanwhile supply sufficient liquid for generating a large amount of vapor during smoking.

Technical Solutions

To this end, the present invention provides a technical solution as follow. An electronic cigarette vaporizer with a liquid storage transition chamber comprises a mouth piece, a liquid reservoir and a vaporizing device, wherein the mouth piece is a housing provided with a mouth piece opening at its top end, the inner wall of the housing is sleeved over and tightly abuts against the outer wall of the upper part of the liquid reservoir, the liquid reservoir comprises an upper wall at its top end, and a vapor outlet tube extending downwards from the center of the upper wall is arranged, wherein the vaporizing device comprises a vaporizing base sleeved at the inner wall of the lower part of the liquid reservoir, and a liquid storage chamber is defined by an empty cavity formed above the vaporizing device and between the inner wall of the liquid reservoir and the outer wall of the vapor outlet tube; and an inner chamber and an outer chamber sealed from each other are formed inside of the vaporizing base, wherein the inner chamber is mounted with a vaporizing unit and serves as a vaporizing chamber, and the outer chamber is filled with liquid storage medium and serves as a liquid storage transition chamber, wherein the vaporizing chamber is in communication with the vapor outlet tube, and the liquid storage transition chamber is in communication with the liquid storage chamber so as to supply liquid for the vaporizing unit.

Preferably, the vaporizing device further comprises a vaporizing sleeve, a connecting sleeve and a throttle plate, wherein the vaporizing sleeve is arranged above a center part of the vaporizing base such that a vaporizing chamber can be defined by the vaporizing sleeve together with the vaporizing base, the inner wall of the upper end of the vaporizing sleeve tightly abuts against the outer wall of the lower end of the vapor outlet tube, wherein the connecting sleeve is sleeved over and tightly abuts against the outer wall of the vaporizing sleeve, wherein the throttle plate is arranged above the outer chamber of the vaporizing base such that a liquid storage transition chamber can be defined by the throttle plate together with the vaporizing base, and the throttle plate may be provided with a plurality of throttle orifices so that the e-cigarette liquid inside the liquid storage chamber can flow into the liquid storage transition chamber in a throttled manner.

Preferably, a snap joint is provided between the inner wall of the mouth piece and the outer wall of the liquid reservoir, to enable a fixed connection there-between, the outer wall of the lower part of the liquid reservoir which is exposed from the mouth piece may be sleeved over and connected to a battery stick to constitute an electronic cigarette, connecting male snaps for snap-fitting to snap-in holes provided on the inner wall of the battery stick to enable a fixed connection are provided on the outer wall of the lower part of the liquid reservoir, wherein a stop shoulder is arranged at the inner wall of the lower part of the liquid reservoir, and the top end of the vaporizing device is stopped from moving upwards by the stop shoulder, and a snap joint is provided between the inner wall of the bottom end of the liquid reservoir and the outer wall of the bottom end of the vaporizing device, to enable a fixed connection there-between, wherein two sides of the outer wall of the lower part of the liquid reservoir are inwardly concaved to form vertical air inlet grooves.

Preferably, the vaporizing base includes an outer wall portion of the vaporizing base, which tightly abuts against the inner wall of the lower part of the liquid reservoir, the bottom part of the vaporizing base comprises a bottom wall of the vaporizing base, the outer wall of the lower end of the outer wall portion of the vaporizing base is provided with a sealing ring, an air intake through-hole is formed in the center of the bottom wall of the vaporizing base, and the bottom wall of the vaporizing base around the air intake through-hole is formed with a circular groove, and a vaporizing wall protruding from an outer periphery of the circular groove is further arranged, wherein the inner chamber is formed inside the vaporizing wall, and the outer chamber is formed between the vaporizing wall and the outer wall of the vaporizing base, wherein the vaporizing unit comprises a liquid guiding strip, a heating coil wounded around a middle part of the liquid guiding strip, and leads connected to two ends of the heating coil, wherein two U-shaped notches extending downwardly are symmetrically provided at the upper end of the vaporizing wall, and the liquid guiding strip is transversely disposed at the two U-shaped notches, with two ends of the liquid guiding strip extending into the liquid storage transition chamber.

Preferably, a liquid refilling tube vertically passing through the vaporizing base and extending into the liquid storage chamber, is arranged in the outer chamber of the vaporizing base, and a plunger for plugging up the tube opening is arranged at the bottom part of the liquid refilling tube.

Preferably, a sealing connector, which is used for sealing between the inner wall of the mouth piece and the outer wall of the liquid reservoir and for communicating the opening of the vapor outlet tube at the top end of the liquid reservoir and the mouth piece opening, is arranged between the mouth piece and the liquid reservoir.

Preferably, the mouth piece and the liquid reservoir have a cross section of a gradient oval, the upper end of the mouth piece is concaved at its two sides such that it has a flatter profile.

Preferably, the vaporizing sleeve is cylinder shaped and comprises a bottom wall of the vaporizing sleeve at its bottom part, and a vapor outlet through-hole is provided in the center of the bottom wall of the vaporizing sleeve, an external diameter of the vaporizing sleeve equals to an external diameter of the vaporizing wall, the bottom part of the vaporizing sleeve is arranged with two wedge parts protruding downwards to fill the U-shaped notches such that only the vaporizing unit can pass through therebetween, the connecting sleeve is tightly sleeved over the outer walls of the vaporizing sleeve and the vaporizing wall, two U-shaped notches extending in an opposite direction are symmetrically provided on the outer wall of the lower part of the connecting sleeve so as to allow the vaporizing unit to pass through.

Preferably, outer wall portion of the vaporizing base is symmetrically provided with two rectangle notches, the throttle plate is disposed on the outer wall portion of the vaporizing base, and two blocking pieces protruding downwards to fill the rectangle notches are arranged at a position of the lower part of the throttle plate corresponding to the rectangle notches.

Preferably, a bottom cap is arranged at the bottom part of the vaporizing base, a bottom cap through-hole which is in communication with the air intake through-hole of the vaporizing base is provided at the center of the bottom cap, a bottom air inlet groove which is in communication with the bottom cap through-hole is transversely arranged at the lower part of the bottom cap, the bottom cap is further arranged with positive and negative electrodes, and a stopping male snap for snap-fitting to corresponding stopping snap-in holes provided at the wall portion of the bottom end of the liquid reservoir is provided on the side surface of the bottom cap.

Technical Advantages

Since the electronic cigarette vaporizer has a liquid storage chamber and also a liquid storage transition chamber arranged in the vaporizing base, having a certain capacity and filled with liquid storage medium, the e-cigarette liquid is supplied to the vaporizing unit from the liquid storage transition chamber instead of from the liquid storage chamber. In such case, the liquid storage transition chamber functions as a buffer transition for the supplying of the e-cigarette liquid, the liquid leakage in normal conditions can be further avoided due to the liquid storage medium, and during smoking the e-cigarette liquid can be supplied to the vaporizing unit quickly to ensure generation of sufficient vapor, thereby greatly improving the taste for users.

Figure 1:
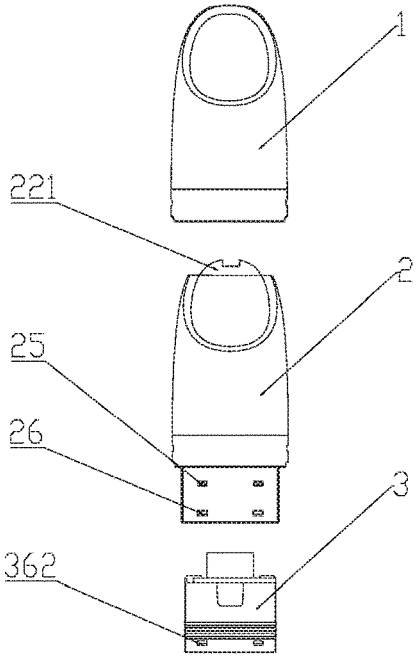
FIG. 1 is a front view illustrating an exploded structure according to an embodiment of the present invention.

Herein, reference numerals of main components are as follows:

1. mouth piece; 10. mouth piece opening; 11. mouth piece tube; 12. air inlet; 13. snap-in hole of mouth piece; 2. liquid reservoir; 20. vapor outlet tube; 21. liquid storage chamber;

22. mounting ledges; 221. sealing connector; 2210. sealing cavity; 2211. connector cut-out; 23. stop shoulder; 24. side male snaps; 25. connecting male snaps; 26. stopping snap-in holes; 27. air inlet grooves; 28. upper wall; 3. vaporizing device; 30. vaporizing base; 301. vaporizing chamber (inner chamber); 302. liquid storage transition chamber (outer chamber); 303. outer wall portion of vaporizing base; 3031. rectangle notches; 3032. sealing rings; 304. bottom wall of vaporizing base; 305. air intake through-hole of vaporizing base; 306. circular groove; 307. vaporizing wall; 3071. U-shaped notches; 308. liquid refilling tube; 3081. plunger; 309. lead holes; 3091. electrode grooves; 31. vaporizing unit; 311. liquid guiding strip; 312. heating coil; 313. leads; 32. liquid storage medium; 33. vaporizing sleeve; 331. bottom wall of vaporizing sleeve; 332. vapor outlet through-hole; 333. wedge parts; 34. connecting sleeve; 341. U-shaped notches extending in an opposite direction; 35. throttle plate; 351. throttle orifices; 352. blocking pieces; 36. bottom cap; 360. bottom cap through-hole; 361. electrode through-hole; 362. stopping male snaps; 363. bottom air inlet groove; 37. positive and negative electrodes; 371. insulation sleeves; 4. battery stick.

DETAILED DESCRIPTION OF ILLUSTRATED EMBODIMENTS

In order to make purposes, technical solutions and advantages of the present invention clearer, the present invention will be further explained in detail with reference to figures and embodiments described hereinafter.

For convenience of description, the electronic cigarette vaporizer with a liquid storage transition chamber of the present invention is described in a condition that the electronic cigarette vaporizer is vertically disposed with its mouth piece 1 facing upward, as shown in FIG. 1. It should be understood that, as used herein, the expresses such as upper, lower, top, bottom, upper end, lower end, upper side and lower side, are intended to indicate orientation and position relationships in a condition that the electronic cigarette vaporizer is vertically disposed with its mouth piece facing upward.

Figure 2:
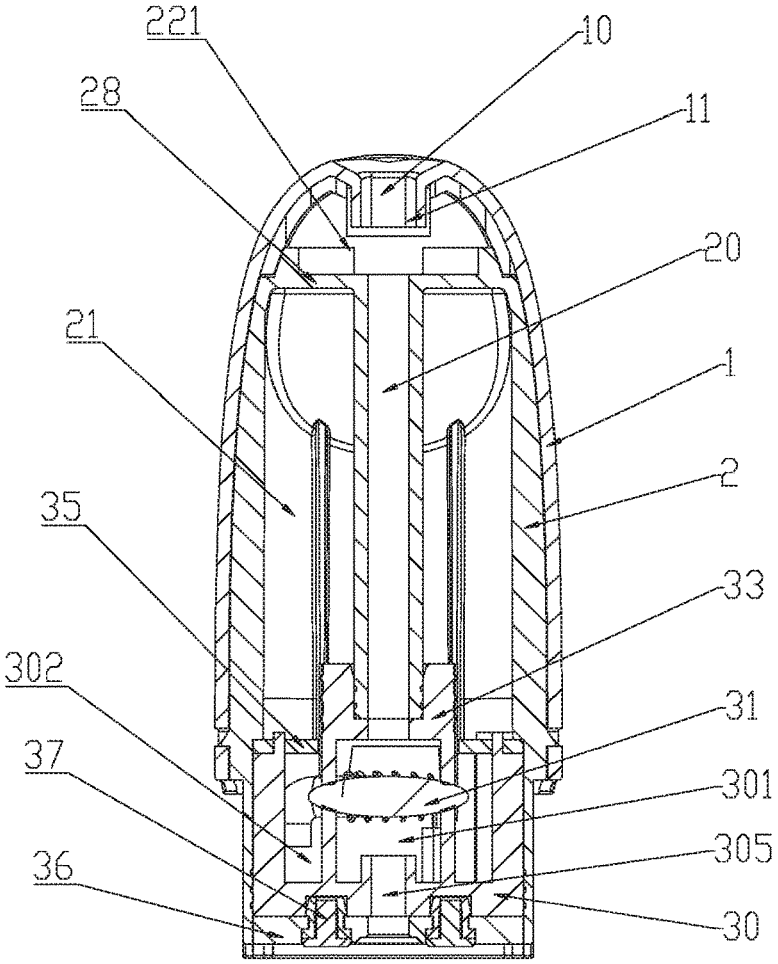
FIG. 2 is a front sectional view illustrating an embodiment of the present invention.
Figure 3:
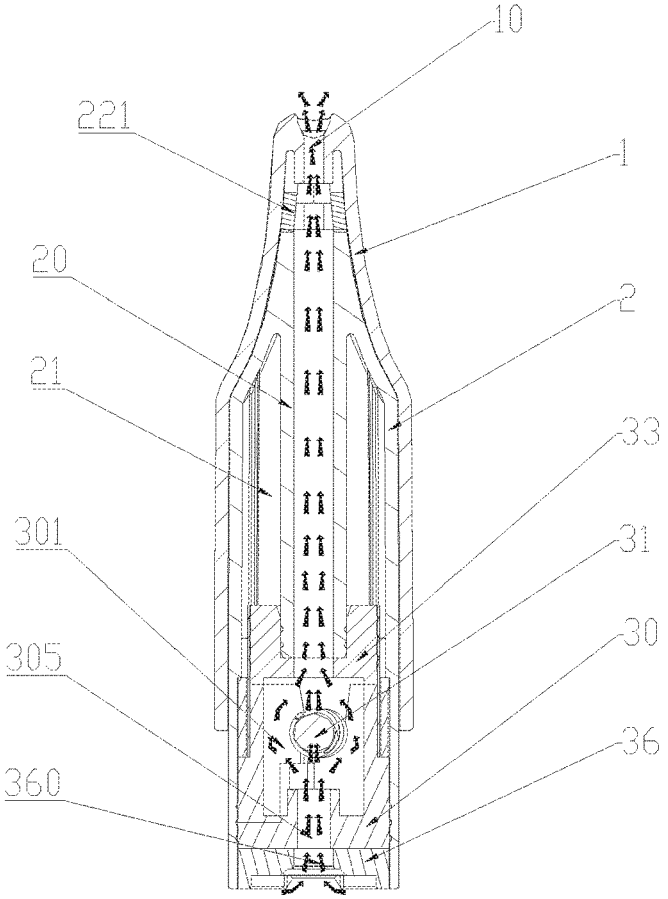
FIG. 3 is a sectional side view illustrating an embodiment of the present invention.

Referring to FIGS. 1-3, an electronic cigarette vaporizer with a liquid storage transition chamber of the present invention comprises a mouth piece 1, a liquid reservoir 2 and a vaporizing device 3. Herein, the mouth piece 1 is a housing provided with a mouth piece opening 10 at its top end. The inner wall of the mouth piece 1 and the outer wall of the liquid reservoir 2 are formed in a same shape, and the inner wall of the mouth piece 1 can be sleeved over the outer wall of the liquid reservoir 2 such that from top to bottom it tightly abuts against the outer wall of the liquid reservoir 2. The liquid reservoir 2 is provided with an upper wall 28 at its upper end, and a vapor outlet tube 20 extending downwards from the center of the upper wall 28 and integrated together with the upper wall 28 is arranged. A vaporizing device 3 is sleeved at the inner wall of the lower end of the liquid reservoir 2, and a liquid storage chamber 21 is defined by a chamber formed above the vaporizing device 3 and between the inner wall of the liquid reservoir 2 and the outer wall of the vapor outlet tube 20. The vaporizing device 3 comprises a vaporizing base 30, and an inner chamber 301 and an outer chamber 302 sealed from each other are formed inside of the vaporizing base 30. Herein, the inner chamber 301 is mounted with a vaporizing unit 31 and serves as a vaporizing chamber 301 which is in communication with the vapor outlet tube 20. The outer chamber 302 can be filled with the liquid storage medium 32 and serves as a liquid storage transition chamber 302, and the liquid storage transition chamber 302 is in communication with the liquid storage chamber 21 and the liquid can be supplied to the vaporizing unit 31 through the liquid storage transition chamber 302. That is, the e-cigarette liquid to be heated and vaporized, instead of being directly absorbed from the liquid storage chamber 21 by the vaporizing unit 31, is absorbed through the liquid storage transition chamber 302. In the present invention, the liquid storage medium 32 may be made of environmental protection materials such as organic cotton, polyester, glass fibers, ceramic fibers and porous ceramics which have good liquid storage performance.

In such configuration, the e-cigarette liquid inside the liquid storage chamber 21 can be free to flow. When the e-cigarette liquid flows into the liquid storage transition chamber 302, it can be absorbed and stored by the liquid storage medium 32. In a non-working state, no pressure differential exists between the inside and the outside of the liquid storage transition chamber 302, and the liquid storage medium 32 can be saturated with the e-cigarette liquid. In such case, due to the adsorption force of the liquid storage medium 32 and the e-cigarette liquid surface tension, the e-cigarette liquid in the liquid storage medium 32 may be restrained from flowing freely, and thus the liquid leakage caused by the e-cigarette liquid freely flowing into the vaporizing chamber 301 through the vaporizing unit 31 can be avoided. During smoking, the e-cigarette liquid in the vaporizing unit 31 is continually heated and gradually vaporized, and a negative pressure is generated in the vaporizing chamber 301. In such case, due to the communication between the vaporizing unit 31 and the liquid storage medium 32 inside the liquid storage transition chamber 302, a predetermined amount of the e-cigarette liquid stored in the liquid storage medium 32 can be quickly supplied to the vaporizing unit 31. Then, the e-cigarette liquid inside the liquid storage chamber 21 can be supplied to the liquid storage medium 32 with a delay, and thus the liquid leakage caused by oversupply of the e-cigarette liquid to the vaporizing unit 31 can be avoided. Hence, the liquid storage transition chamber 302 functions as a buffer transition for the supplying of the e-cigarette liquid. Furthermore, due to the liquid storage medium 32, the liquid leakage can be further avoided in normal conditions, and during smoking a quick supply of the e-cigarette liquid can be realized so that sufficient vapor can be generated.

Referring to FIGS. 2, 3, 8 and 9, the vaporizing device 3 further comprises a vaporizing sleeve 33, a connecting sleeve 34 and a throttle plate 35. Herein, the vaporizing sleeve 33 is arranged above the center part of the vaporizing base 30, and the vaporizing chamber 301 is defined by the vaporizing sleeve 33 together with the vaporizing base 30. The inner wall of the upper end of the vaporizing sleeve 33 tightly abuts against the outer wall of the lower end of the vapor outlet tube 20. The connecting sleeve 34 is sleeved over the vaporizing sleeve 33 and tightly abuts against the outer wall of the vaporizing sleeve 33. The throttle plate 35 is arranged above the liquid storage transition chamber 302 of the vaporizing base, and the liquid storage transition chamber 302 is defined by the throttle plate 35 together with the vaporizing base 30. The throttle plate 35 is provided with a plurality of throttle orifices 351 so that the e-cigarette liquid inside the liquid storage chamber 21 can flow into the liquid storage transition chamber 302 in a throttled manner. With the arrangement of the throttle plate 35, when the e-cigarette liquid is supplied to the liquid storage transition chamber 302 from the liquid storage chamber 21 during smoking, the e-cigarette liquid is supplied to the liquid storage medium 32 inside the liquid storage transition chamber 302 in a further delayed or buffered manner due to the throttling function of throttle orifices 351, and thus the liquid leakage caused by oversupply of the e-cigarette liquid to the vaporizing unit 31 can be avoided.

Referring to FIGS. 2-7 and 26, a snap joint is provided between the inner wall of the mouth piece 1 and the outer wall of the liquid reservoir 2, to enable a fixed connection there-between. In particular in the present embodiment, two side wall portions of the liquid reservoir 2 are respectively arranged with a side male snap 24, and two side wall portions of the mouth piece 1 are respectively provided with a snap-in hole 13 of mouth piece to which the corresponding side male snap 24 can be snap-fitted. When the mouth piece 1 is sleeved onto the liquid reservoir 2 from above downwards, the side male snaps 24 can be snap-fitted to the snap-in holes 13 of mouth piece, to allow the mouth piece 1 and the liquid reservoir 2 to be connected and fixed with each other. A battery stick 4 may be sleeved over and connected to the outer wall of the lower part of the liquid reservoir 2 which is exposed from the mouth piece 1, to constitute an electronic cigarette. Connecting male snaps 25 which can be snap-fitted to snap-in holes (not shown in the drawings) provided on the inner wall of the battery stick to enable a fixed connection are provided on the outer wall of the lower part of the liquid reservoir 2. A stop shoulder 23 for stopping the top end of the vaporizing device 3 from moving upwards is arranged at the inner wall of the lower part of the liquid reservoir 2. Furthermore, a snap joint is provided between the inner wall of the bottom end of the liquid reservoir 2 and the outer wall of the bottom end of the vaporizing device 3, to enable a fixed connection there-between. In particular, the inner wall of the bottom end of the liquid reservoir 2 is provided with stopping snap-in holes 26, and the outer wall of the bottom end of the vaporizing device 3 is arranged with stopping male snaps 362 which can be snap-fitted to the stopping snap-in holes 26 to allow the vaporizing device 3 to be sleeved fixedly at the inner wall of the lower part of the liquid reservoir 2. Furthermore, two sides of the outer wall of the lower part of the liquid reservoir 2 are inwardly recessed to form air inlet grooves 27 extending vertically. In the case that the electronic cigarette vaporizer of the present invention is connected to the battery stick 4 to constitute an electronic cigarette, air inlets 12 for letting in air are provided at the upper end of the air inlet groove 27 and the lower end of the mouth piece 1. During smoking, outside air enters the bottom part of the vaporizing device 2 through the air inlet 12 and the air inlet groove 27, and then enters into the vaporizing chamber 301.

Referring to FIGS. 9-13, the vaporizing base 30 includes an outer wall portion 30 of the vaporizing base, which is correspondingly shaped to conform to the inner wall of the lower part of the liquid reservoir 2 so that it can tightly abuts against the inner wall of the lower part of the liquid reservoir. The outer wall of the lower end of the outer wall portion 303 of the vaporizing base is provided with sealing rings 3032. The bottom part of the vaporizing base 30 comprises a bottom wall 304 of the vaporizing base, an air intake through-hole 305 of the vaporizing base is formed in the center of the bottom wall 304 of the vaporizing base, and a circular groove 306 is formed on the bottom wall 304 of the vaporizing base around the air intake through-hole 305 of the vaporizing base. A circular-tube shaped vaporizing wall 307 protruding from the outer periphery of the circular groove 306 is further arranged, and the vaporizing wall 307 may have a same height as the outer wall portion 303 of the vaporizing base. The inner chamber 301 is formed inside the vaporizing wall 307, and the liquid storage transition chamber 302 is formed between the vaporizing wall 307 and the outer wall portion 303 of the vaporizing base. The vaporizing unit 31 comprises a liquid guiding strip 311, a heating coil 312 wounded around the middle part of the liquid guiding strip 311, and leads 313 connected to two ends of the heating coil 312. Two U-shaped notches 3071 which extend downwardly are symmetrically provided at the upper end of the vaporizing wall 307, and the liquid guiding strip 311 is transversely disposed at the two U-shaped notches 3071, with two ends of the liquid guiding strip 311 extending into the liquid storage transition chamber 302 and being in close contact with the liquid storage medium 32. The vaporizing sleeve 33 is arranged above the vaporizing wall 307. The circular groove 306 serves to receive and collect the droplets of the e-cigarette liquid that are not vaporized completely and contained in the vapor, to prevent such droplets from entering the user's mouth and leading to undesired taste. The vaporizing base 30 of the present invention may be made of heat-resisting materials such as silica gel, ceramic and thermoplastic elastomer. The liquid guiding strip 311 of the present invention may be made of materials which are heat-resisting, easy to store and have good liquid transfer performance, such as glass fiber rope and ceramic fibers.

Figure 14:
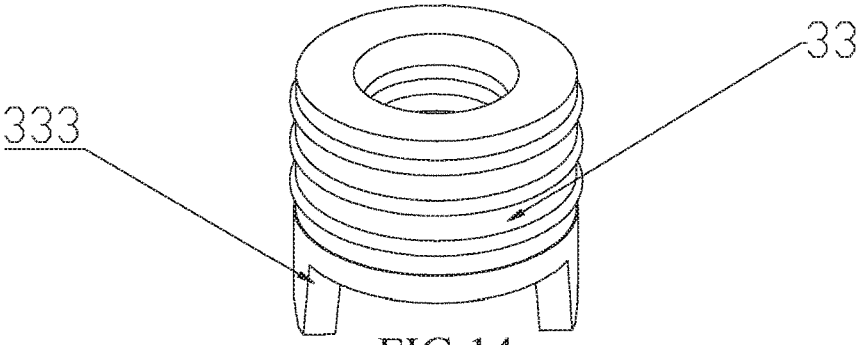
FIG. 14 is a perspective view of a vaporizing sleeve according to an embodiment of the present invention.
Figure 15:
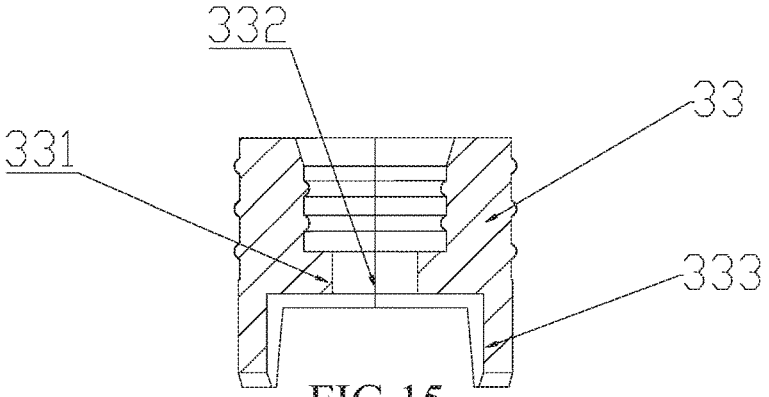
FIG. 15 is a front sectional view of a vaporizing sleeve according to an embodiment of the present invention.
Figure 16:
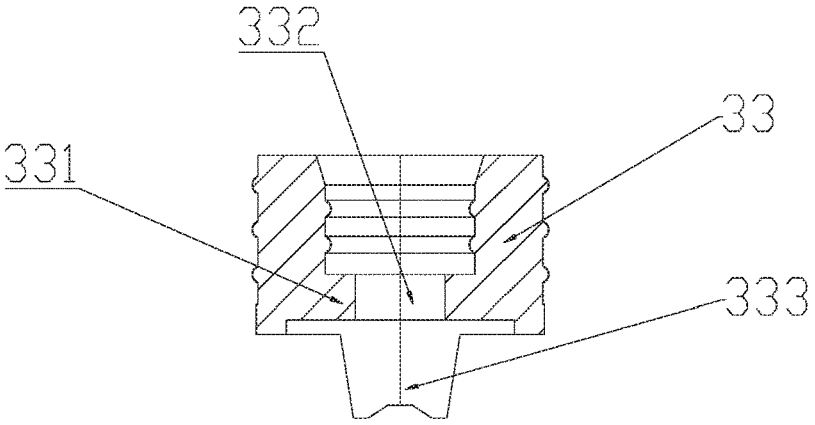
FIG. 16 is a sectional side view of a vaporizing sleeve according to an embodiment of the present invention.

Referring to FIGS. 14-16, the vaporizing sleeve 33 is cylinder shaped and comprises a bottom wall 331 of the vaporizing sleeve at its bottom part, and a vapor outlet through-hole 332 is provided in the center of the bottom wall 331 of the vaporizing sleeve. The external diameter of the vaporizing sleeve 33 equals to the external diameter of the vaporizing wall 307. The bottom part of the vaporizing sleeve 33 is arranged with two wedge parts 333 protruding downwards to fill the U-shaped notches 3071 such that only the vaporizing unit 31 can pass through therebetween. The wedge parts 333 serve to close the U-shaped notches 3071 and ensure the sealing between the vaporizing chamber 301 and the liquid storage transition chamber 302. The vaporizing sleeve 33 of the present invention may be made of heat-resisting materials such as silica gel, ceramic and TPE.

Figure 8:
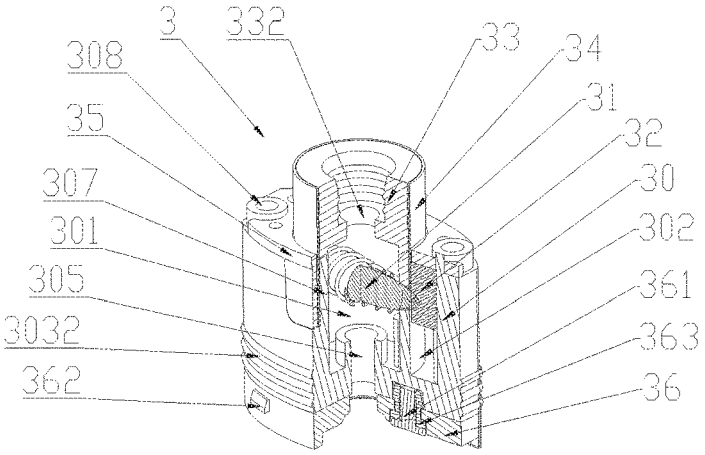
FIG. 8 is a partial perspective sectional view of a vaporizing device according to an embodiment of the present invention.
Figure 9:
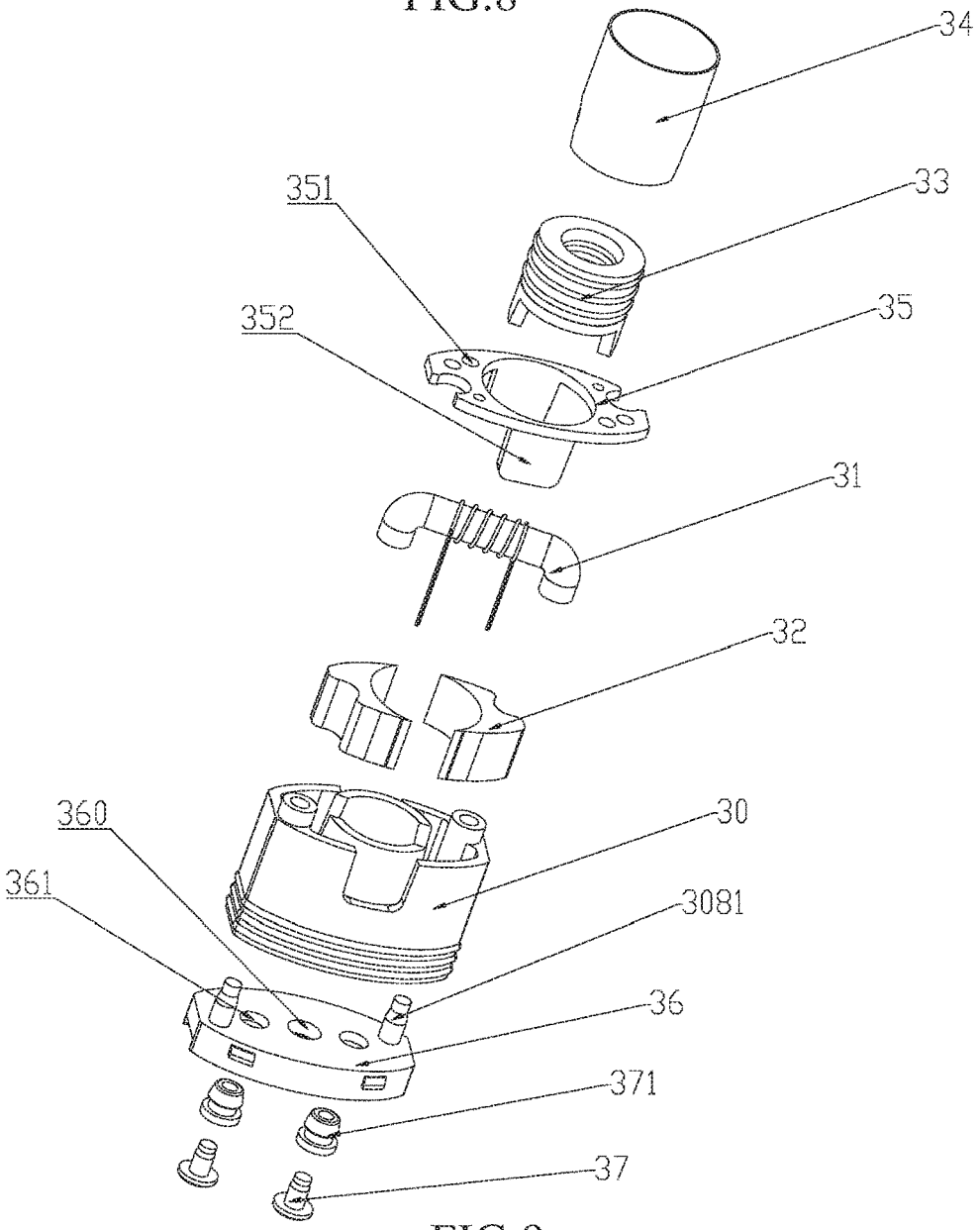
FIG. 9 is an exploded view of a vaporizing device according to an embodiment of the present invention.
Figure 17:
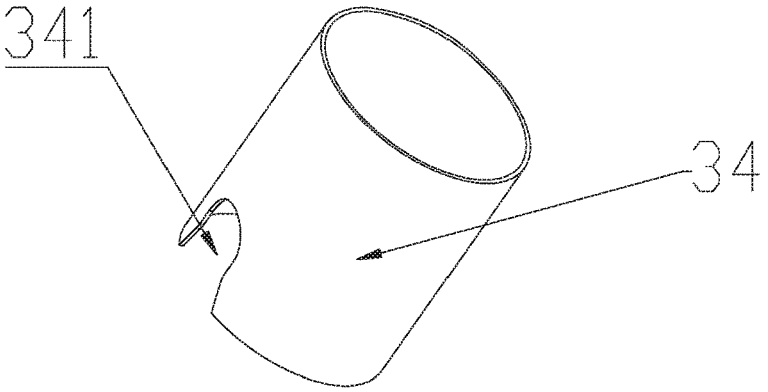
FIG. 17 is a perspective view of a connecting sleeve according to an embodiment of the present invention.
Figure 18:
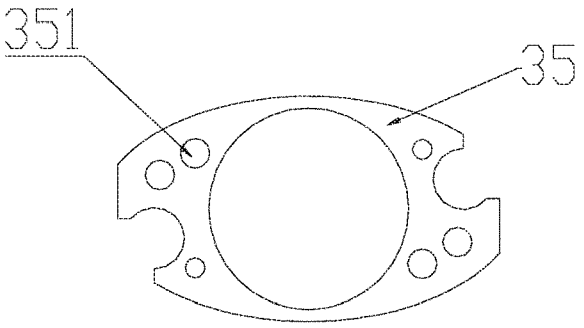
FIG. 18 is a top view of a throttle plate according to an embodiment of the present invention.
Figure 19:
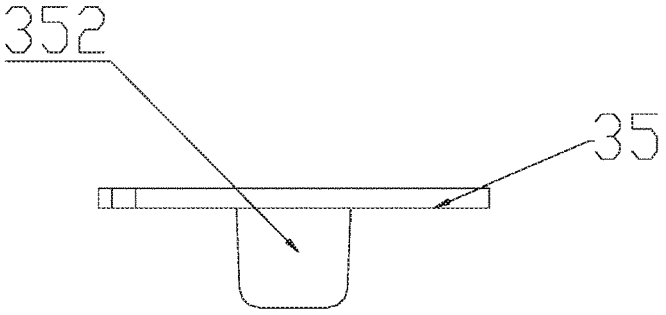
FIG. 19 is a front view of a throttle plate according to an embodiment of the present invention.
Figure 20:
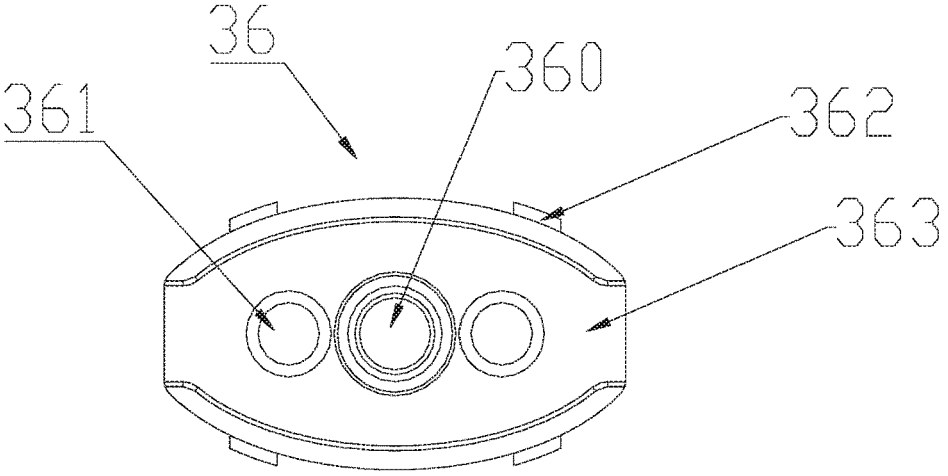
FIG. 20 is a bottom view of a bottom cap according to an embodiment of the present invention.
Figure 21:
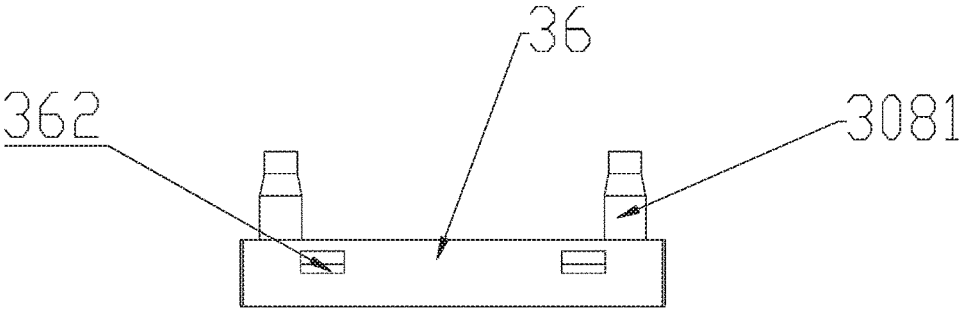
FIG. 21 is a front view of a bottom cap according to an embodiment of the present invention.

Referring to FIGS. 8, 9 and 17, the connecting sleeve 34 is tightly sleeved over the outer walls of the vaporizing sleeve 33 and the vaporizing wall 307. Two U-shaped notches 341 extending in an opposite direction are symmetrically provided on the outer wall of the lower part of the connecting sleeve 34 so as to allow the vaporizing unit 31 to pass through. The connecting sleeve 34 has functions of protecting, fixing and closely connecting the vaporizing sleeve 33 and the vaporizing wall 307. Furthermore, due to the vaporizing sleeve 33, the vaporizing wall 307, the connecting sleeve 34 and the liquid storage transition chamber 302, the heat inside the vaporizing chamber 301 can be isolated, and thus heat damage to the wall of the liquid reservoir 2 caused by high-temperature can be prevented and poor user experience for the user who holds the electronic cigarette consisting of the electronic cigarette vaporizer by hands can be avoided.

Referring to FIGS. 8-11 and 18-19, outer wall portion 303 of the vaporizing base is symmetrically provided with two rectangle notches 3031, the throttle plate 35 is disposed on the outer wall portion 303 of the vaporizing base, and two blocking pieces 352 protruding downwards to fill the rectangle notches 3031 are arranged at a position of the lower part of the throttle plate 35 corresponding to the rectangle notches 3031. With the configuration of the rectangle notches 3031 and the blocking pieces 352, the throttle plate 35 can be fixed and prevented from falling off.

Referring to FIGS. 8-11, in the present embodiment of the present invention, a liquid refilling tube 308 passing through the vaporizing base 30, extending above the upper end surface of the vaporizing base 30, and extending into the liquid storage chamber 21, is arranged in the liquid storage transition chamber 302 of the vaporizing base. A plunger 3081 for plugging up the tube opening is arranged at the bottom part of the liquid refilling tube 308, and the plunger 3081 may be made of soft materials to ensure the sealing of the liquid refilling tube. The e-cigarette liquid can be refilled into the liquid storage chamber 21 through the liquid refilling tube 308. When the e-cigarette liquid runs out, the user can easily pull the plunger 3081 out and refill the e-cigarette liquid into the liquid storage chamber 21 through the liquid refilling tube 308.

Referring to FIGS. 8-9 and 20-21, a bottom cap 36 is arranged at the bottom part of the vaporizing base 30, a bottom cap through-hole 360 which is in communication with the air intake through-hole 305 of the vaporizing base is provided at the center of the bottom cap 36, and a bottom air inlet groove 363 which is in communication with the bottom cap through-hole 360 is transversely arranged at the lower part of the bottom cap 36. The bottom air inlet groove 363 is in communication with both air inlet grooves 27 arranged at two sides of the liquid reservoir 2. The bottom cap 36 is further arranged with positive and negative electrodes 37. In the present embodiment, the positive and negative electrodes 37 are inserted in the electrode through-holes 361 provided in the bottom cap 36, and insulation sleeves 371 are arranged between the positive and negative electrodes 37 and the electrode through-holes 361, respectively. The bottom cap male snap 362 provided on the side surface of the bottom cap 36 can be engaged with corresponding engaging part 23 of the liquid reservoir provided at the wall portion of the bottom end of the liquid reservoir 2. Furthermore, the bottom part of the vaporizing base 30 is further provided with electrode grooves 3091 which serve to receive the positive and negative electrodes 37 extending beyond the upper surface of the bottom cap 36, and lead holes 309 through which the leads 313 of the vaporizing unit 31 can pass, so that leads 313 passing through the bottom wall 304 of the vaporizing base can be respectively connected with the positive and negative electrodes 37. In other embodiments, the positive and negative electrodes 37 may also be embedded in the bottom cap 36. In the present embodiment, the plunger 3081 of the liquid refilling tube may be fixedly connected to the bottom cap 36. In such case, when opening the bottom cap 36, the plunger 3081 can be pulled out at the same time, so as to allow refilling of the e-cigarette liquid into the liquid storage chamber 21 through the liquid refilling tube 308.

Figure 10:
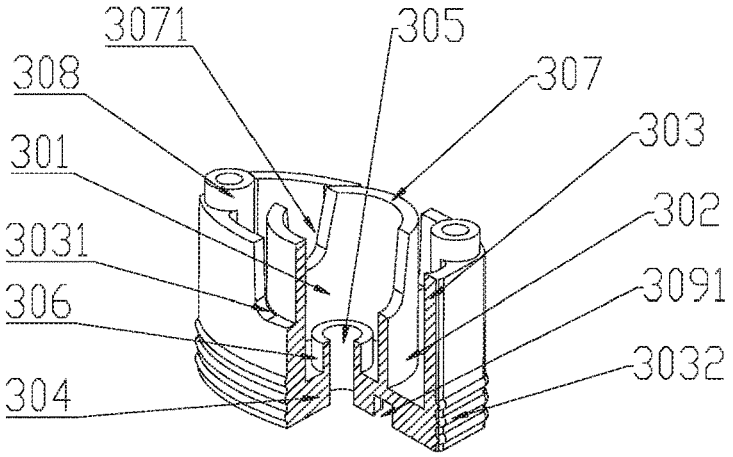
FIG. 10 is a partial perspective sectional view of a vaporizing base according to an embodiment of the present invention.
Figure 11:
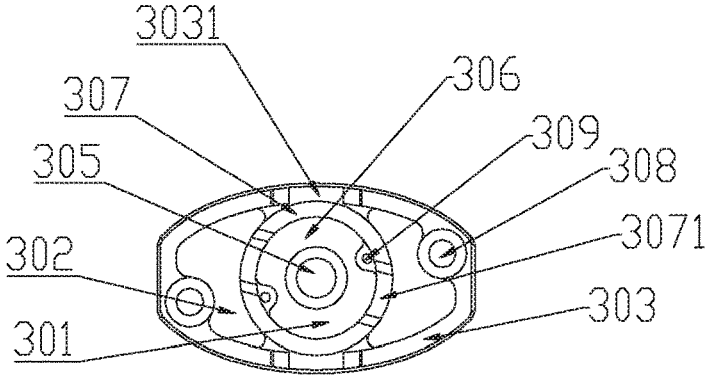
FIG. 11 is a top view of a vaporizing base according to an embodiment of the present invention.
Figure 12:
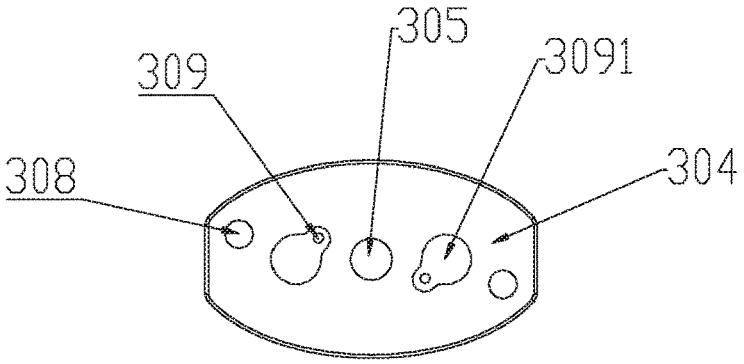
FIG. 12 is a bottom view of a vaporizing base according to an embodiment of the present invention.
Figure 13:
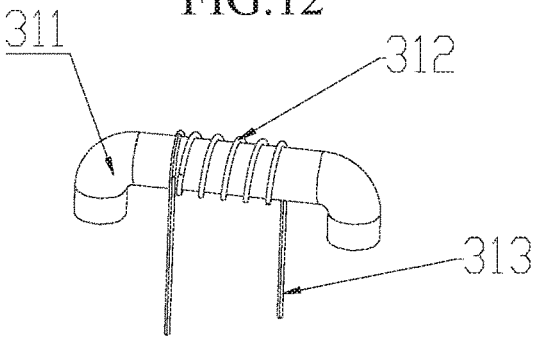
FIG. 13 is a perspective view of a vaporizing unit according to an embodiment of the present invention.

Referring to FIGS. 8-10, the outer wall of the lower end of the outer wall portion 303 of the vaporizing base is arranged with sealing rings 3032. In the present embodiment, the vaporizing base 30 may be made of soft silica gel material or rubber material. In such case, the sealing ring 3032 and the outer wall portion 303 of the vaporizing base are integrally formed. That is, protrusions protruding on the outer wall of the lower end of the outer wall portion 303 of the vaporizing base serve as a plurality of sealing rings 3032 for sealing between the outer wall portion of vaporizing base and the inner wall of the liquid reservoir to avoid leakage from liquid storage chamber 21.

Referring to FIGS. 2, 3 and 22-25, a sealing connector 221 is arranged between the mouth piece 1 and the liquid reservoir 2, and the sealing connector 221 is used for sealing between the inner wall of the mouth piece 1 and the outer wall of the liquid reservoir 2 and communicating the opening of the vapor outlet tube 20 at the top end of the liquid reservoir 2 and the mouth piece opening 10 of the mouth piece 1. In the present embodiment, in order to facilitate the mounting of the sealing connector 221, the end part of the upper end of the liquid reservoir 2 is arranged with two mounting ledges 22, and a sealing cavity 2210 formed in the sealing connector 221 is mounted on the two mounting ledges 22 such that the sealing connector 221 can be supported by the mounting ledges 22. Furthermore, the upper part of the sealing connector 221 is provided with a connector cut-out 2211 which can be sleevedly connected with the mouth piece tube 11 extending downwards from the mouth piece opening 10. In such case, the lower part of the sealing cavity 2210 of the sealing connector 221 is in communication with the opening of the vapor outlet tube 20, and the upper part is hermetically connected and in communication with the mouth piece tube 11 inside the mouth piece opening 10, thereby ensuring that all vapor in the region from the vaporizing chamber 301 to the vapor outlet tube 20 can be inhaled by the user during smoking, and air leakage between the inner wall of the mouth piece 1 and the outer wall of the liquid reservoir 2 can be avoided.

During smoking, as indicated by the arrows as shown in FIG. 3, the electronic cigarette vaporizer of the present invention works with the air and the vapor flowing as follows. Outside air flows through the air inlet 12, the air inlet groove 27, the bottom air inlet groove 363, the bottom cap through-hole 360, the air intake through-hole 305 of the vaporizing base, and then enters into the vaporizing chamber 301. The cigarette liquid is heated and vaporized by means of the vaporizing unit 31 to generate vapor, and then the generated vapor flows out from the vaporizing chamber 301, flows through the vapor outlet through-hole 332, the vapor outlet tube 20, the sealing cavity 2210 of the sealing connector, the mouth piece tube 11 and the mouth piece opening 10, and then enters the user's mouth.

Figure 4:
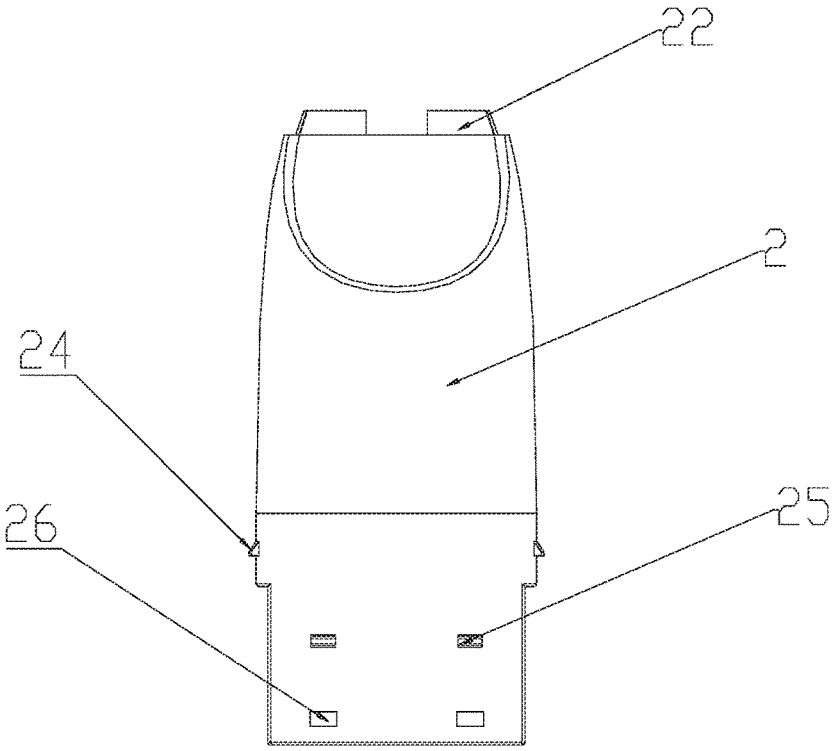
FIG. 4 is a front view of a liquid reservoir according to an embodiment of the present invention.
Figure 5:
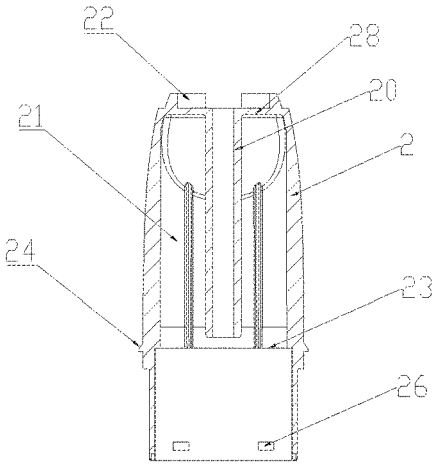
FIG. 5 is a front sectional view of a liquid reservoir according to an embodiment of the present invention.
Figure 6:
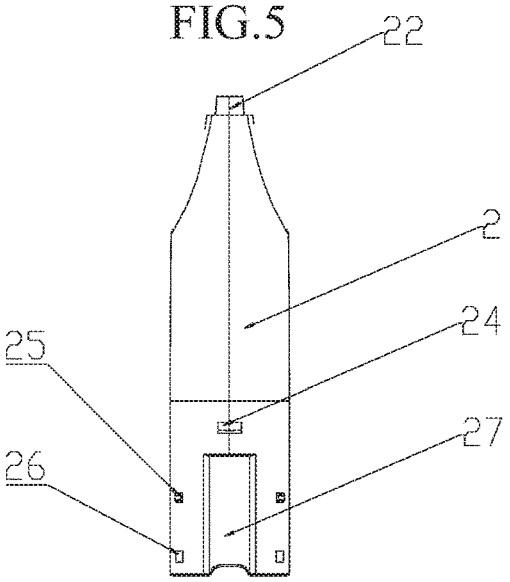
FIG. 6 is a side view of a liquid reservoir according to an embodiment of the present invention.
Figure 7:
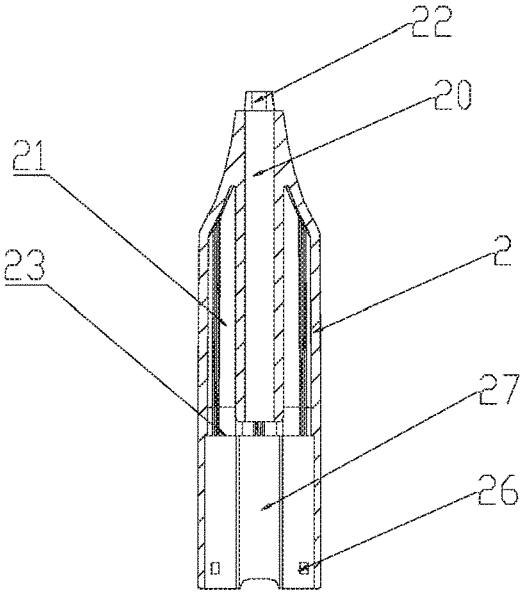
FIG. 7 is a sectional side view of a liquid reservoir according to an embodiment of the present invention.
Figure 22:
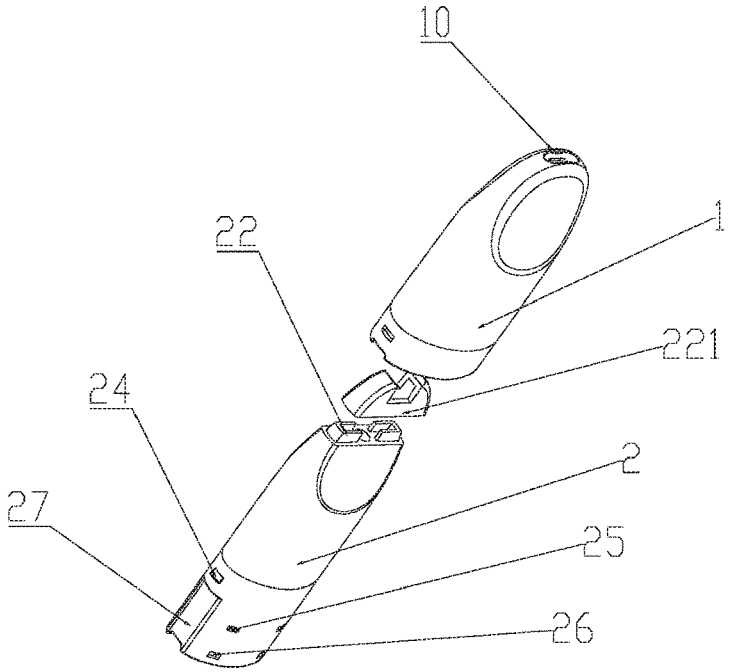
FIG. 22 is a schematic view illustrating a mouth piece, a sealing connector and a liquid reservoir in an exploded state according to an embodiment of the present invention.
Figure 23:
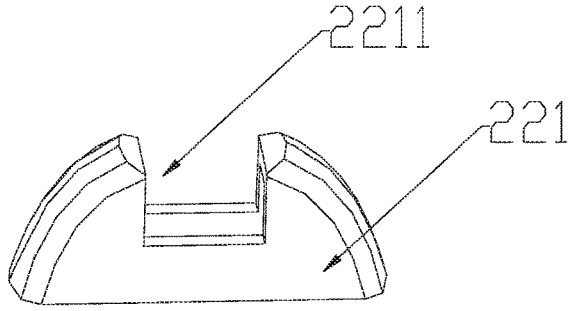
FIG. 23 is a perspective view of a sealing connector according to an embodiment of the present invention.
Figure 24:
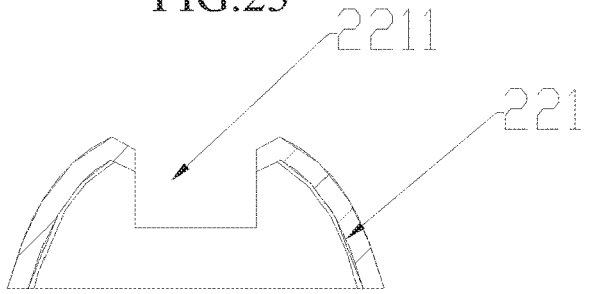
FIG. 24 is a front sectional view of a sealing connector according to an embodiment of the present invention.
Figure 25:
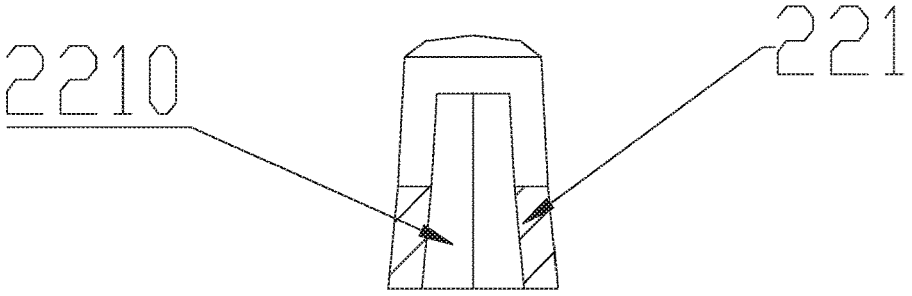
FIG. 25 is a sectional side view of a sealing connector according to an embodiment of the present invention.
Figure 26:
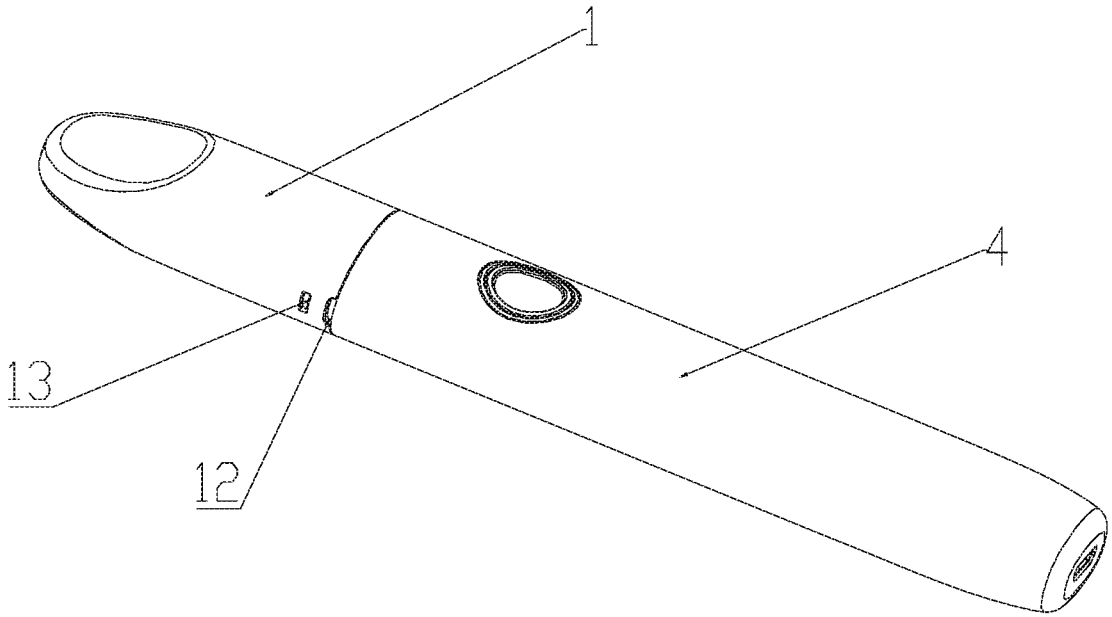
FIG. 26 is a perspective view illustrating an electronic cigarette vaporizer according to an embodiment of the present invention being connected with a battery stick to form an electronic cigarette.

Referring to FIGS. 4, 22 and 26, the mouth piece 1 and the liquid reservoir 2 have a cross section of a gradient oval, the upper end of the mouth piece 1 is concaved at its two sides such that it has a flatter profile fitting for human' mouth and facilitates comfortable user experience. Alternatively, in other embodiments, the mouth piece 1 and the liquid reservoir 2 may have other shapes. Connecting male snaps 25 arranged on the outer wall of the lower end of the liquid reservoir 2 can be connected and fixed in a snap-fit manner with snap-fit parts (not shown in the drawings) arranged at the housing of the battery stick 4, to allow the electronic cigarette vaporizer of the present invention and the battery stick to constitute a complete electronic cigarette.

INDUSTRIAL APPLICABILITY

All the above are merely preferred embodiments of the present invention, which are not intended to limit the present invention in any form. The present invention is intended to cover all changes, various modifications and equivalent arrangements those skilled in the art can make according to the technical essence of the present invention.

The invention claimed is:

1. An electronic cigarette vaporizer with a liquid storage transition chamber, the electronic cigarette vaporizer comprising a mouth piece, a liquid reservoir and a vaporizing member, wherein the mouth piece is a housing provided with a mouth piece opening at a top end of the housing, an inner wall of the housing is sleeved over and tightly abuts against an outer wall of an upper part of the liquid reservoir, the liquid reservoir comprises an upper wall at a top end of the liquid reservoir, and a vapor outlet tube extending downwards from the center of the upper wall is arranged, wherein the vaporizing member comprises a vaporizing base and is sleeved at an inner wall of a lower part of the liquid reservoir, and a liquid storage chamber is defined by an empty cavity formed above the vaporizing member and between an inner wall of the liquid reservoir and an outer wall of the vapor outlet tube; and an inner chamber and an outer chamber sealed from each other are formed inside of the vaporizing base, wherein the inner chamber is mounted with a vaporizing unit and serves as a vaporizing chamber, and the outer chamber is filled with liquid storage medium and serves as the liquid storage transition chamber, the vaporizing chamber is in communication with the vapor outlet tube, and the liquid storage transition chamber is in communication with the liquid storage chamber and serves to supply liquid for the vaporizing unit, the vaporizing member further comprises a throttle plate, wherein the throttle plate is arranged above the outer chamber of the vaporizing base such that the liquid storage transition chamber is defined by the throttle plate together with the vaporizing base, and the throttle plate is provided with a plurality of throttle orifices for allowing e-cigarette liquid inside the liquid storage chamber to flow into the liquid storage transition chamber in a throttled manner.

2. The electronic cigarette vaporizer with the liquid storage transition chamber according to claim 1, characterized in that, the vaporizing device further comprises a vaporizing sleeve, and a connecting sleeve, wherein the vaporizing sleeve is arranged above a center part of the vaporizing base such that a vaporizing chamber can be defined by the vaporizing sleeve together with the vaporizing base, an inner wall of an upper end of the vaporizing sleeve tightly abuts against an outer wall of a lower end of the vapor outlet tube, wherein the connecting sleeve is sleeved over and tightly abuts against an outer wall of the vaporizing sleeve.

3. The electronic cigarette vaporizer with the liquid storage transition chamber according to claim 1, characterized in that, a snap joint is provided between an inner wall of the mouth piece and an outer wall of the liquid reservoir, to enable a fixed connection there-between, a lower part of the outer wall of the liquid reservoir is exposed from the mouth piece to allow a connection with a battery stick to constitute an electronic cigarette, a connecting male snap for allowing snap-fitting to the battery stick to enable a fixed connection is provided on the outer wall of the lower part of the liquid reservoir, wherein a stop shoulder is arranged at the inner wall of the lower part of the liquid reservoir, and a top end of the vaporizing member is stopped from moving upwards by the stop shoulder, and a snap joint is provided between an inner wall of a bottom end of the liquid reservoir and an outer wall of a bottom end of the vaporizing member, to enable a fixed connection there-between, wherein two sides of the outer wall of the lower part of the liquid reservoir are arranged with a vertical air inlet groove inwardly concaved.

4. The electronic cigarette vaporizer with the liquid storage transition chamber according to claim 1, characterized in that, the vaporizing base includes an outer wall portion of the vaporizing base, which tightly abuts against the inner wall of the lower part of the liquid reservoir, a bottom part of the vaporizing base comprises a bottom wall of the vaporizing base, an outer wall of a lower end of the outer wall portion of the vaporizing base is provided with a sealing ring, an air intake through-hole is formed in the center of the bottom wall of the vaporizing base, and the bottom wall of the vaporizing base around the air intake through-hole is formed with a circular groove, and a vaporizing wall protruding from an outer periphery of the circular groove is further arranged, the inner chamber is formed inside the vaporizing wall, and the outer chamber is formed between the vaporizing wall and the outer wall portion of the vaporizing base, wherein the vaporizing unit comprises a liquid guiding strip, a heating coil wounded around a middle part of the liquid guiding strip, and leads connected to two ends of the heating coil, wherein two U-shaped notches extending downwardly are symmetrically provided at an upper end of the vaporizing wall, and the liquid guiding strip is transversely disposed at the two U-shaped notches, with two ends of the liquid guiding strip extending into the liquid storage transition chamber.

5. The electronic cigarette vaporizer with the liquid storage transition chamber according to claim 1, characterized in that, a liquid refilling tube vertically passing through the vaporizing base and extending into the liquid storage chamber, is arranged in the outer chamber of the vaporizing base, and a plunger for plugging up a tube opening is arranged at a bottom part of the liquid refilling tube.

6. The electronic cigarette vaporizer with the liquid storage transition chamber according to claim 1, characterized in that, a sealing connector, which is used for sealing between an inner wall of the mouth piece and an outer wall of the liquid reservoir and for communicating an opening of the vapor outlet tube at the top end of the liquid reservoir and the mouth piece opening, is arranged between the mouth piece and the liquid reservoir.

7. The electronic cigarette vaporizer with the liquid storage transition chamber according to claim 1, characterized in that, the mouth piece and the liquid reservoir have a cross section of a gradient oval, an upper end of the mouth piece is concaved at its two sides of the upper end of the mouth piece such that the upper end of the mouth piece has a flatter profile.

8. The electronic cigarette vaporizer with the liquid storage transition chamber according to claim 4, characterized in that, the vaporizing sleeve is cylinder shaped and comprises a bottom wall of the vaporizing sleeve at a bottom part of the vaporizing sleeve, and a vapor outlet through-hole is provided in the center of the bottom wall of the vaporizing sleeve, an external diameter of the vaporizing sleeve equals to an external diameter of the vaporizing wall, a bottom part of the vaporizing sleeve is arranged with two wedge parts protruding downwards to fill the U-shaped notches such that only the vaporizing unit can pass through therebetween, the connecting sleeve is tightly sleeved over outer walls of the vaporizing sleeve and the vaporizing wall, two U-shaped notches extending in an opposite direction are symmetrically provided on an outer wall of a lower part of the connecting sleeve so as to allow the vaporizing unit to pass through.

9. The electronic cigarette vaporizer with the liquid storage transition chamber according to claim 4, characterized in that, the outer wall portion of the vaporizing base is symmetrically provided with two rectangle notches, the throttle plate is disposed on the outer wall portion of the vaporizing base, and two blocking pieces protruding downwards to fill the rectangle notches are arranged at a position of a lower part of the throttle plate corresponding to the rectangle notches.

10. The electronic cigarette vaporizer with the liquid storage transition chamber according to claim 4, characterized in that, a bottom cap is arranged at a bottom part of the vaporizing base, a bottom cap through-hole which is in communication with the air intake through-hole of the vaporizing base is provided at the center of the bottom cap, a bottom air inlet groove which is in communication with the bottom cap through-hole is transversely arranged at a lower part of the bottom cap, the bottom cap is further arranged with positive and negative electrodes, and a stopping male snap for snap-fitting to a corresponding stopping snap-in hole provided at a wall portion of a bottom end of the liquid reservoir is provided on a side surface of the bottom cap.

* * * * *